US006953439B1

(12) United States Patent
Kabemba

(10) Patent No.: US 6,953,439 B1
(45) Date of Patent: Oct. 11, 2005

(54) THERAPEUTIC MATTRESS

(75) Inventor: Albert Kabemba, Tampa, FL (US)

(73) Assignee: University of South Florida, Tampa, FL (US)

( * ) Notice: Subject to any disclaimer, the term of this patent is extended or adjusted under 35 U.S.C. 154(b) by 0 days.

(21) Appl. No.: 10/604,121

(22) Filed: Jun. 26, 2003

Related U.S. Application Data

(60) Provisional application No. 60/319,359, filed on Jun. 27, 2002.

(51) Int. Cl.[7] ..... A61H 1/00
(52) U.S. Cl. ..... 601/47; 601/55; 5/904
(58) Field of Search ..... 5/666, 674, 654, 5/655.5, 904, 644, 689, 655.9, 909; 601/2, 601/47, 49, 55

(56) References Cited

U.S. PATENT DOCUMENTS

| | | | | |
|---|---|---|---|---|
| 3,346,221 | A * | 10/1967 | Everett | 267/140.13 |
| 3,556,088 | A * | 1/1971 | Leonardini | 601/47 |
| 3,880,152 | A * | 4/1975 | Nohmura | 601/47 |
| 4,748,972 | A * | 6/1988 | Hasegawa | 601/2 |
| 5,035,235 | A * | 7/1991 | Chesky | 601/47 |
| 5,063,912 | A * | 11/1991 | Hughes | 601/47 |
| 5,101,810 | A * | 4/1992 | Skille et al. | 601/47 |
| 5,113,852 | A * | 5/1992 | Murtonen | 601/47 |
| 5,314,403 | A * | 5/1994 | Shaw | 601/148 |
| 5,628,230 | A | 5/1997 | Flam | |
| 5,638,558 | A | 6/1997 | Moore | |
| 5,669,094 | A * | 9/1997 | Swanson | 5/740 |
| 5,695,455 | A * | 12/1997 | Alton, Jr. et al. | 601/47 |
| 5,826,841 | A * | 10/1998 | Lavore | 248/118 |
| 6,027,463 | A * | 2/2000 | Moriyasu | 601/46 |
| 6,119,291 | A * | 9/2000 | Osborne et al. | 601/55 |
| 6,159,574 | A * | 12/2000 | Landvik et al. | 428/71 |
| 6,175,980 | B1 * | 1/2001 | Gaither | 5/654 |
| 6,199,234 | B1 * | 3/2001 | Srour et al. | 5/736 |
| 6,202,239 | B1 * | 3/2001 | Ward et al. | 5/727 |
| 6,237,173 | B1 * | 5/2001 | Schlichter et al. | 5/722 |
| 6,353,763 | B1 | 3/2002 | George et al. | |
| 6,493,888 | B1 * | 12/2002 | Salvatini et al. | 5/423 |
| 6,708,355 | B1 * | 3/2004 | Wang et al. | 5/644 |
| 6,813,790 | B2 * | 11/2004 | Flick et al. | 5/713 |
| 2002/0108179 | A1 * | 8/2002 | Kiser | 5/654 |

(Continued)

FOREIGN PATENT DOCUMENTS

WO PCT/US99/16055 4/1997

OTHER PUBLICATIONS

Defloor et al.; Preventing Pressure Ulcers: An Evaluation of Four Operating-Table Mattresses; Applied Nursing Research; vol. 13, No. 3, p. 134-141; Aug. 2000.

(Continued)

*Primary Examiner*—Michael Safavi
(74) *Attorney, Agent, or Firm*—Molly L. Sauter; Smith & Hopen, P.A.

(57) ABSTRACT

The present invention includes a mattress having a fluid-based center portion encapsulated by a stablizing visco-elastic polyurethane covering adapted to prevent lateral or longitudinal movement while a patient is disposed thereon. One or more sonic speakers disposed below or coincident to the fluid-based center generate fluid sound waves. Responsive to the sound waves, the fluid oscillates. The mechanical oscillation of the fluid is translated to the visco-elastic polyurethane covering upon which the patient is disposed. The therapeutic effects of the ultrasound oscillations speed the rate of healing and enhance the quality of tissue repair. Furthermore, the stabilizing effects of the covering make the mattress stationary for surgical operations.

11 Claims, 1 Drawing Sheet

U.S. PATENT DOCUMENTS

2003/0208848 A1* 11/2003 Flick et al. ..... 5/713

OTHER PUBLICATIONS

Beckrich et al.; Hospital-Acquired Pressure Ulcers: A Comparison of Costs in Medical vs. Surgical Patients; Nursing Economics; vol. 17, No. 5; Sep.-Oct. 1999.
Pressure Ulcers: Prevention and Management; www.mayo.edu/geriatrics-rst/PU.html; Mar. 2002.
Waffle and DermaCare Mattress Replacements; www.ehob.com/consumers/products/mattress_replacements.html; Mar. 2002.
Vibrasound Environment; www.themindspa.com/technologies/vs.html; Mar. 2002.
NPUAP Database of Current Pressure Ulcer Research Funding; www.rst.pitt.edu/npuap/index.html; Mar. 2002.
Waffle Mattress Overlay with M.A.D. Pump; www.ehob.com/consumers/products/mattress_pad.html; Mar. 2002.
Gen Gel; www.genadyne.com/html/mfg_products.html; Mar. 2002.
Therapeutic Ultrasound; www.electrotherapy.org/electro/ultrasound/therapeutic_ultrasound.htm; Apr. 2002.
Pressure Ulcers in Adults: Prediction & Prevention; U.S. Department of Health & Human Science; 1992.
Allman et al.; Pressure Ulcer Risk Factors Among Hospitalised Patients with Activity Limitation;Journal of the American Medical Association; 1995.
Allman; Pressure Ulcer Prevalence Incidence, Risk Factors and Impact; Geraitr Medical; 1997.
Andersen et al.; Decubitus ProphylaxisL A Prospective Trial on the Efficiency of Alternating Pressure Air Mattresses and Waler Mattresses; Acta Dermatovener; 1982.
Aronovitch; A Comparative Randomized Controlled Study to Determine Safety and Efficacy of Preventive Pressure Ulcer Systems; Advances in Wound Care; 1998.
Bailliere's Nurses Dictionary 22nd Edition; Bailliere Tindall; 1997.
Bennett; Report of the Task Force on Implications of Darkly Pigmented Intact Skin in the Predication and Prevention of Pressure Ulcers; Advances in Wound Care; 1995.
Bergstrom et al.; A Prospective Study of Pressure Sore Risk Among Institutionalised Elderly; Journal of the American Geriatrics Society; 1992.
Bergstrom et al.; Using a Research-Based Assessment Scale in Clinical Practice; Nuring Clinics of North America; 1995.
Bergstrom et al.; Multi-site Study of Incidence of Pressure Ulcers and the Relationship Between Risk Level; Journal of the American Geriatrics Society; 1996.
Berlowitz et al.; Risk Factors for Pressure Sores; A Comparison of Cross Sectional & Cohort Derived Data; Journal of the American Geriatrics Society; 1989.
Berlowitz et al.; The Short-Term Outcome of Pressure Sores; Journal of the American Geriztrics; 1990.
BLISS; Preventing Pressure Sores; Lancet; 1990.
Branseis et al.; A Longitudinal Study of Risk Factors Associated with the Formation of Pressure Ulcers in Nursing Homes; Journal of the American Geriatrics; 1994.
Clark et al.; The Incidence of Pressure Sores in a National Health Service Trust; Journal of Advanced Nursing; 1994.
Clark; Repositioning to Prevent Pressure Sores—What is the Evidence?; Nursing Standard; 1998.
Colin et al.; Comparison of 90 Degress & 30 Degree Laterally Inclined Positions in the Prevention of Pressure; Advances in Wound Care; 1996.
Collier; Pressure-Reducing Mattresses; Journal of Wound Care; 1996.
Collier; Pressure Ulcer Development & Principles for Prevention; NTBooks Emap London; 1999.
Collier; Hyperaemia; Journal of Wound Care; 1999.
Connie et al.; Pressure Sore Prophylaxis in Elderly Patients Using Polyurethane Foam or Jay Wheelchair Cushions; International Journal of Rehabilitation Research; 1994.
Cullum et al.; Intrinsic Factors Associated with Pressure Sores in Elderly People; Journal of Advanced Nursing; 1992.
Cullum et al.; Preventing and Treating Pressure Sores; Quality in Health Care; 1995.
Cullum et al.; Mattresses and Cushions for Preventing & Treating Pressure Sores; Update Software Oxford; 2000.
Dealey; Managing Pressure Sore Prevention; Quary Books Salisbury Wiltshire; 1997.
Defloor; The Effect of Posture and Mattress on the Development of Pressure Ulcers; Macmillan Magazine London; 1997.
Defloor; The Risk of Pressure Sores: A Conceptual Scheme; Journal of Clinical Nursing; 1999.
Defloor; The Effect of Position and Mattress on Interface Pressure; Applied Nursing Research; 1999.
The Health of the Nation; The Stationery Office London; 1992.
Pressure Sores: A Key Quality Indicator; The Stationery Office London; 1993.
The New NHS Modern Dependable; The Stationery Office London; 1997.
Our Healthier Nation; The Stationery Office London; 1999.
Benchmarking the Fundamentals Aspects of Care; 2000.
Dunlop; Preliminary Results of a Randomised Controlled Study of a Pressure Ulcer Prevention System; 1998.
Dyson; Bed Sores the Injuries Hospital Staff Inflict on Patients; Nursing Mirror; 1978.
EHCB; NHS Centre for Reviews and Dissemination. The Prevention and Treatment of Pressure Sores; Effective Health Care Bulletin; 1995.
EPUAP; Pressure Ulcer Prevention Guidelines; European Pressure Ulcer Advisory Panel Oxford; 1999.
Ewing et al.; Further Experiences in the Use of Sheep Skins as an Aid to Nursing; The Australian Nurses' Journal; 1964.
Finucance; Malnutrition Tube Feeding and Pressure Sores: Data re Imcomplete; Journal of American Geriatric Society; 1995.
Franks et al.; Quality of Life in Patients Suffering from Pressure Ulceration: A Case Controlled Study; Osteomy and Wound Management; 1999.
Garber et al.; Reported Pressure Ulcer Prevention and Management Techniques by Persons with Spinal Cord Injury; Archives of Physical Medicine and Rehabilitation; 1996.
Gebhardt et al.; Prevention of Pressure Sores in Orthopaedic Patients is Prolonged Chair Nursing Detrimental?; Journal of Tissue Viability; 1994.
Goldstone et al: The Norton Score: An Early Warning of Pressure Ulcers?; Journal of Advanced Nursing; 1982.
Gray et al.; A Randomised Clinical Trial of Two Types of Foam Mattresses;Journal of Tissue Viability; 1994.
Harding; A Glossary of Common Terms in Wound Care; Journal of Wound Care; 2000.
Heinemann Medical Dictionary; William Heinemann Medical Books London; 1986.

Hibbs; Pressure Area Care Policy; City of Hackney Health Authority London; 1988.
Hofman et al; Pressure Sores and Pressure-Decreasing Mattresses: Controlled Clinical Trial; Lancet; 1994.
Inman et al.; Clinical Utility and Cost Effectiveness of an Air Suspension Bed in the Prevention of Pressure Ulcers: Journal of the American Medical Association; 1993.
Lim et al.; Clinical Trial of Foam Cushions in the Prevetion of Decubitis Ulcers in Elderly Patients; Journal of Rehabilitation Research; 1988.
Mann; Clinical Audit in the NHS: NHSE Leeds; 1996.
McGough; A Systematic Review of the Effectiveness of Risk Assessment Scales Used in the Prevention and Management of Pressure Sores; University of York Thesis; 1999.
Moody et al.; Impact of Staff Education on Pressure Sore Development in Elderly Hospitalised Patients; Archives Internal Medicine; 1988.
Morrell et al.; The Clinical Audit Handbook. Improving the Quality of Health Care; Bailliere Tindall London; 1999.
Nixon et al.; A Sequential Randomised Controlled Trial Comparing a Dry Viso-Elastic Polymer Pad; International Journal of Nursing Studies; 1998.
Papantonio et al.; Sacral Ulcers Following Cardiac Surgery: Incidence and Risks; Advances in Wound Care; 1994.
Pope; Pressure Sore Formation in the Operating Theatre; British Journal of Nursing; 1999.
Fact Sheet 2. Raising Standards of Care; Royal College of Nursing London; 1999.
Rycroft-Malone; The Challenge of a Weak Evidence Baseformal Consensus and Guideline Development; Journal of Clinical Excellence; 2000.
Rycroft-Malone: Pressure Ulcer Risk Assessment and Prevention Guideline: Technical Report; Royal College of Nursing; 2001.
Salvadalena et al.; Clinical Trial of the Braden Scale on an Acute Medical Unit; Journal of Enterostomal Therapy; 1992.
Santy et al.; A Comparision Study of 6 Types of Hospital Matteress to Determine Which Most Effectively Reduces the Incidence of Pressure Sores; Report of Northern & Yorkshire; 1994.
Scott et al.; Measurement of Interface Pressures in the Evaluation of Operating Theatre Mattresses; Journal of Wound Care; 1999.
Scott; The Prevention of Pressure Ulcers in the Operating Department; Journal of Wound Care; 2000.
Shiffmann; Representation of Clinical Practice Guidelines in Conventional and Augmented Decision Tables; Journal of the American Medical Informatics Association; 1997.
The United Nations Convention of the Rights of the Child; HMSO London; 1991.
Touche; The Cost of Pressure Sores; Touche Ross & Company London; 1993.
Vandenbosch et al.; Predictive Validity of the Braden Scale and Nurse Perception in Identifying Pressure Ulcer Risk; Applied Nursing Research; 1996.
Verluysen; Hoe Elderly Patients with Femoral Fractures Develop Presure Sores in Hospital; British Medical Journal; 1986.
Waddell et al.; Low Back Pain Evidence Review; Royal College of General Practitioners London.
Doring et al.; Studies of the Fluctuations of Skin Blood Flow in infants Under Different Environmental Noise Levels; Z Kinderheilkd; 109(3):211-220; 1971.
Dengerink et al.; The Recovery of Vascular Changes Following Brief Noise Exposure; Acta Otolaryngol; Jul.-Aug. 100(1-2):19-25; 1985.
Paran'ko; Regional Vascular Reactions During Exposure to Vibration and Noise, Individually & Together; Gig Sanit; Nov. 33(11):19-24; 1968.
Fuchs-Schmuck et al.; The Effect of Defined Noise Exposure on the Peripheral Circulatory System; Z Gesamte Hyg.; Sep. 15 (9):651-653; 1969.
Redick; Effect of "Massage" on Venous Blood Flow; Anesth Analg; Dec. 77(6):1306-1307; 1993.
Flohr; Autoradiographic Studies on Regional Blood Flow in the Renal Cortex; Pflugers Arch.; 307(2):R57-58; 1969.
Singh et al.; Effect of Chronic and Acute Exposure to Noise on Physiological Functions in Man; Int Arch Occup Environ Health; 50(2):169-174; 1982.
Hansen et al.; Effect of Massage, Shortwave Diathermy and Ultrasound upon 133Xe Disappearance Rate from Muscle & Subeutaneous . . . ; Scand J Rehabil Med.; 5(4):179-182; 1973.
Hovind et al.; Local Blood Flow After Short-Wave Diathermy; Preliminary Report; Arch Phys Med Rehabil; May 55(5):217-221; 1974.
Hovind et al.; Effect of Massage on Blood Flow in Skeletal Muscle; Scand J Rehabil Med.; 6(2):74-77; 1974.
Wiles et al.; Pulsed Ultrasound Therapy and Skin Blood-Flow; Lancet; Sep. 5, 2(8558):572; 1987.
Wyper et al.; Therapeutic Ultrasound and Muscle Blood Flow; Physiotherapy; Oct. 64(10):321-322; 1978.
Mune; Ultrasonic Therapy; Ugeskr Laeger; Nov. 19, 135 (47):2574; 1973.
McCulloch; Altrasound in Wound Healing; www.medicaledu.com/ultrasnd.htm; Apr. 10, 2002.
A Controlled Trial of Weekley Ultrasound Therapy in Chironic Led Ulceration; The Lancet; Jul. 25, 1987.

* cited by examiner

THERAPEUTIC MATTRESS

This application claims benefit of provisional U.S. application No. 60/319,359, filed Jun. 27, 2002.

BACKGROUND OF INVENTION

1. Field of Invention

This invention relates to mattresses, and more particularly to therapeutic mattresses for reducing pressure ulcers during surgery.

2. Background of the Invention

The incidence of pressure ulcer formation on surgical units and post-operative facilities varies between 7 to 66%. Factors that contribute to pressure ulcer formation for hospitalized patients are: body habits, co-morbid disease, age, type of surgery and inter-operative duration. The incidence of peri-operative pressure ulcers can be decreased by reducing operative time or intensity of pressure and shear force on the human body during surgery. One method of accomplishing the latter is to provide a pressure-relief surface to reduce the interface pressure via a combination mattress that relieves interface pressure and provides dynamic pressure reduction.

Accordingly, what is needed in the art is a fluid-based sonic therapeutic mattress suitable for surgical use.

It is, therefore, to the effective resolution of the aforementioned problems and shortcomings of the prior art that the present invention is directed.

However, in view of the prior art in at the time the present invention was made, it was not obvious to those of ordinary skill in the pertinent art how the identified needs could be fulfilled.

SUMMARY OF INVENTION

The present invention includes a mattress having a fluid-based center portion encapsulated by a stablizing visco-elastic polyurethane covering adapted to prevent lateral or longitudinal movement while a patient is disposed thereon. One or more sonic speakers disposed below or coincident to the fluid-based center generate fluid sound waves. Responsive to the sound waves, the fluid oscillates. The mechanical oscillation of the fluid is translated to the visco-elastic polyurethane covering upon which the patient is disposed. The therapeutic effects of the ultrasound oscillations speed the rate of healing and enhance the quality of tissue repair. Furthermore, the stabilizing effects of the covering make the mattress stationary for surgical operations.

Accordingly, a preferred embodiment of the present invention is a therapeutic mattress including a stabilizing visco-elastic polyurethane outer shell about 4-inches thick having a viscosity sufficiently resilient for the performance of surgical procedures, a visco-elastic polyurethane inner shell about 2.5-inches thick disposed within the outer shell, a waterproof circumferential surface enclosing the outer shell, a fluid-based inner cavity encapsulated by the inner shell, the fluid-based inner cavity is filled with compressible shock absorbing fluid, a plurality of speakers emitting low frequency resonance generating fluid sound waves in sonic communication with the fluid-based inner cavity, the speakers are in parallel arrangement throughout the bottom surface of the inner mattress and an external control adapted to adjust the frequency emitted through the speakers.

DETAILED DESCRIPTION

Figure 1:
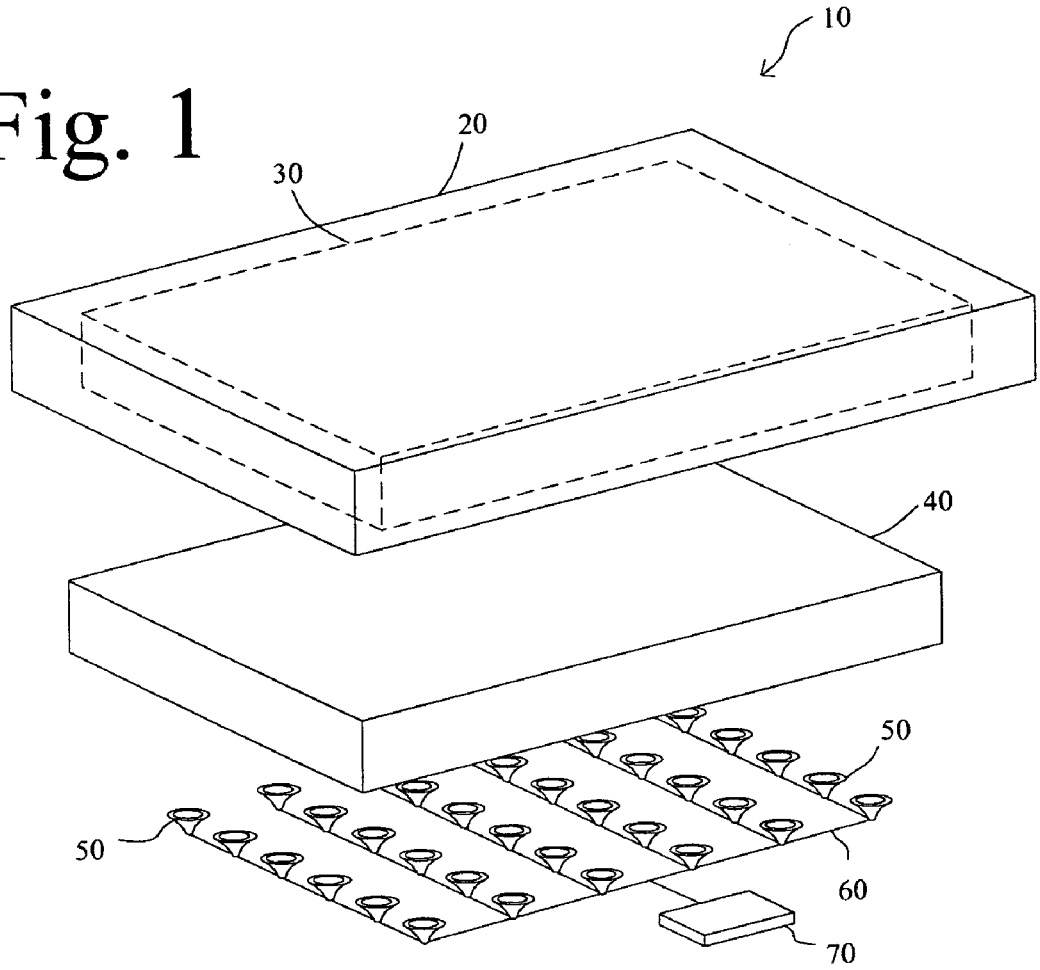
FIG. 1 is a partially sectional, isometric exploded view of the invention.
Figure 2:
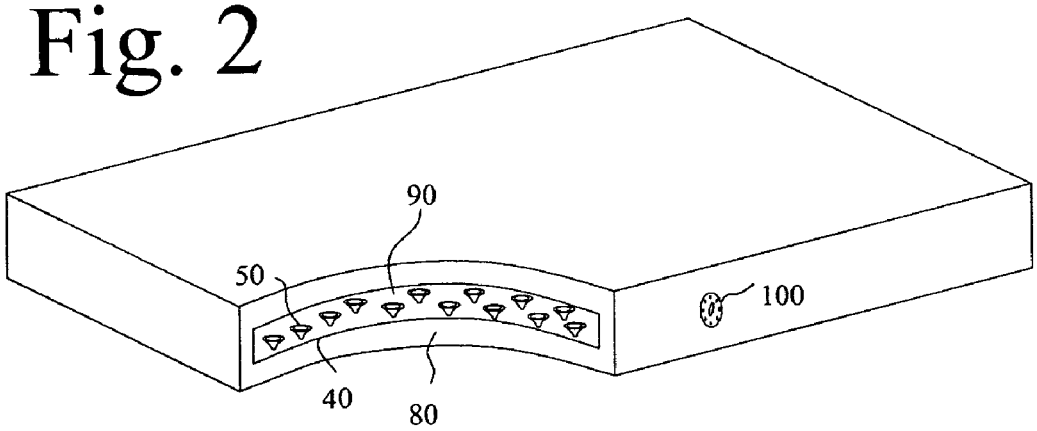
FIG. 2 is a partially sectional, isometric view of the invention.

FIG. 1 shows an exploded view of the mattress 10 wherein outer shell 20 is a 4-inch thick visco-elastic polyurethane material 80 (FIG. 2). An inner cavity 30 is defined within the outer shell 20. The mattress is the standard operating room mattress length and width with a thin fluid/waterproof circumferential surface. The inner shell is 2.5-inch thick mattress 40 composed of polyurethane material filled with non-compressible shock absorbing fluid 90. The inner mattress core contains manifolds 60 of miniature sonic speakers 50 placed in various locations in parallel throughout bottom surface of the mattress 40. These sonic speakers 50 serve to create a fluid sound wave. Hence fluid 90 within the inner mattress 40 (FIG. 2) is made to oscillate and form "fluid sound waves" via sonic energy. These sonic speakers 50 emit a low frequency resonance to create sound propagation in fluid 90. The frequency can be adjusted from an external dial 100 to increase the amplitude of the fluid sound wave. However, the frequency will not beyond the limit of low frequency band. This will help to ensure that waves are propagated further and maintain integrity. Power supply 70 provides low voltage current and electrical signals to the speakers 50.

The effects of sound on the body in this fashion, especially area of increase interface pressure, is to temporarily relieve pressure while promoting blood flow. Hence combating some of the problems faced during prolonged immobilization during surgery. The ultimate effect is to decrease interface pressure and shear force by infinitesimal fluid sonic stimulation of the skin, blood medium/small vessels and capillaries and muscle tissues via: (1) oscillating "fluid sound wave" and (2) pressure reduction afforded by the visco-elastic material. Pressure relief and reduction is achieved by the continuous shifting and releasing of pressure points as well as enhancing blood flow by similar mechanism as massage therapy. All this can be accomplished with the application of a sonic wave fluid propagation technology.

The mattress is removable with industrial strength Velcro straps that wrap fully around underneath the table; and four corner pouches that slip onto each o.r. table corner for a tight and secure fit.

It will be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described,

What is claimed is:

1. A therapeutic mattress comprising a stabilizing visco-elastic polyurethane outer shell, a visco-elastic polyurethane inner shell disposed within the outer shell, a fluid-based inner cavity encapsulated by the inner shell, and a plurality of speakers in sonic communication with the fluid-based inner cavity, the plurality of speakers positioned to establish a sonic wave within a fluid of the fluid-based inner cavity.

2. The mattress of claim 1, wherein the viscosity of the polyurethane shell is sufficiently resilient for the performance of surgical procedures.

3. The mattress of claim 1, wherein the outer shell is about 4-inches thick.

4. The mattress of claim 1, wherein the inner shell is about 2.5-inches thick.

5. The mattress of claim 1, whereby a waterproof circumferential surface encloses the outer shell.

6. The mattress of claim 1, whereby the fluid-based inner cavity is comprised of compressible shock absorbing fluid.

7. The mattress of claim 1, wherein the speakers are disposed below the fluid-based inner cavity.

8. The mattress of claim 7, wherein the speakers emit low frequency resonance generating fluid sound waves.

9. The mattress of claim 7, wherein the speakers are in parallel arrangement throughout the bottom surface of the inner mattress.

10. The mattress of claim 8, whereby the frequency emission is adjustable through an external control.

11. A therapeutic mattress comprising a stabilizing visco-elastic polyurethane outer shell about 4-inches thick having a viscosity sufficiently resilient for the performance of surgical procedures, a visco-elastic polyurethane inner shell about 2.5-inches thick disposed within the outer shell, a waterproof circumferential surface enclosing the outer shell, a fluid-based inner cavity encapsulated by the inner shell, the fluid-based inner cavity is filled with compressible shock absorbing fluid, a plurality of speakers emitting low frequency resonance generating fluid sound waves in sonic communication with the fluid-based inner cavity, the speakers are in parallel arrangement throughout the bottom surface of the inner mattress and an external control adapted to adjust the frequency emitted through the speakers.

* * * * *